US011458379B1

(12) United States Patent
Leskiff et al.

(10) Patent No.: US 11,458,379 B1
(45) Date of Patent: Oct. 4, 2022

(54) GOLF PROTRACTOR TOOL AND PRACTICE TOOL SYSTEM

(71) Applicant: SWING MASON LLC, Steamboat Springs, CO (US)

(72) Inventors: Walter Leskiff, Steamboat Springs, CO (US); Harri Bronskyy, Toronto (CA)

(73) Assignee: SWING MASON LLC, Steamboat Springs, CO (US)

( * ) Notice: Subject to any disclaimer, the term of this patent is extended or adjusted under 35 U.S.C. 154(b) by 0 days.

(21) Appl. No.: 17/380,205

(22) Filed: Jul. 20, 2021

Related U.S. Application Data

(60) Provisional application No. 63/103,142, filed on Jul. 20, 2020.

(51) Int. Cl.
*A63B 69/36* (2006.01)

(52) U.S. Cl.
CPC ..... *A63B 69/3621* (2020.08); *A63B 69/3667* (2013.01)

(58) Field of Classification Search
CPC ..... A63B 69/3621; A63B 69/3667
USPC ..... 473/218, 257, 266, 270–273, 278, 279
See application file for complete search history.

(56) References Cited

U.S. PATENT DOCUMENTS 1,208,995 A * 12/1916 Lyon ..... A63B 69/3667 33/508
1,632,267 A * 6/1927 Beem ..... B43L 13/24 33/473
2,169,407 A * 8/1939 Crowley ..... A63B 69/3667 473/272
2,652,251 A * 9/1953 Molinar ..... A63B 69/3667 473/218
3,658,344 A * 4/1972 Kimble ..... A63B 69/3667 473/272
4,326,718 A 4/1982 Kiehl
4,993,716 A 2/1991 Waller
5,205,045 A * 4/1993 Liu ..... B23Q 9/005 33/468
5,527,037 A * 6/1996 Matsumoto ..... A63B 69/3667 473/218
5,685,782 A 11/1997 Lipps et al.
5,759,110 A 6/1998 Seibel et al.
5,938,539 A 8/1999 Hamilton
6,106,408 A * 8/2000 Roman ..... A63B 69/3667 473/270
6,488,592 B1 12/2002 Boatner
(Continued)

OTHER PUBLICATIONS

U.S. Appl. No. 17/110,177, filed Dec. 2, 2020, inventors Leskiff et al. [Per MPEP 609.04(a)(II), copy not provided as this application is available in the USPTO system].

*Primary Examiner* — Nini F Legesse
(74) *Attorney, Agent, or Firm* — Polson Intellectual Property Law, PC; Margaret Polson; Christopher Sylvain

(57) ABSTRACT

A golf protractor tool having a base bar, a protractor extending from a side of the base bar, and a swing arm pivotably mounted to the protractor. The protractor is a semicircular protractor with a 180° arc. The swing arm is positionally adjustable along the 180° arc of the protractor. Each of the swing arm and the base bar have one or more rod holder openings configured to hold practice rods. Additionally, a practice rod stake tool is also described which may be used independently or together with the protractor tool, thereby providing a golf tool kit or system.

20 Claims, 7 Drawing Sheets

(56) References Cited

U.S. PATENT DOCUMENTS

| | | | | |
|---|---|---|---|---|
| 6,669,575 | B1 * | 12/2003 | Marlette | A63B 69/3667 473/270 |
| 7,153,216 | B1 | 12/2006 | Pressley | |
| 8,696,482 | B1 | 4/2014 | Pedenko et al. | |
| 8,840,484 | B2 | 9/2014 | Parke et al. | |
| 8,961,328 | B1 | 2/2015 | Schmok | |
| 8,974,314 | B2 | 3/2015 | Basile | |
| 9,022,877 | B2 | 5/2015 | Biliner | |
| 9,999,394 | B2 | 6/2018 | Shibuya et al. | |
| 10,463,939 | B2 | 11/2019 | Baker | |
| 2004/0023726 | A1 | 2/2004 | Ritson et al. | |
| 2005/0009616 | A1 | 1/2005 | Dickie | |
| 2015/0148145 | A1 | 5/2015 | Jeffrey | |
| 2017/0065868 | A1 | 3/2017 | Taniguchi | |
| 2017/0326427 | A1 | 11/2017 | Smith et al. | |

* cited by examiner

GOLF PROTRACTOR TOOL AND PRACTICE TOOL SYSTEM

APPLICATION CROSS REFERENCE

This application claims the benefit of provisional application No. 63/103,142 filed Jul. 20, 2020, which is incorporated by reference herein.

BACKGROUND

Professional training sessions can help golfers identify and correct swing mechanics. However, continuous professional training can become expensive, and golfers will sometimes relapse to previous tendencies when practicing on their own. Therefore, many personal use tools and methods have been developed for practicing a golf stance setup and swinging motion, in order to ingrain proper mechanics into the golfer's muscle memory. However, such tool aids are often limited to a specific aspect of the swing and/or lack versatility for different clubs and swings. Many other tool aids are also relatively large and cumbersome.

The foregoing examples of the related art and limitations therewith are intended to be illustrative and not exclusive. Other limitations will become apparent to those skilled in the art upon a reading of the specification and a study of the drawings.

SUMMARY

The following embodiments and aspects thereof are described and depicted in conjunction with systems, tools and methods which are meant to be illustrative, not limiting in scope. In various embodiments, one or more problems have been reduced or eliminated, while other embodiments are directed to other improvements.

Proceeding from this background, the present disclosure relates to a golf practice tool, in particular a golf protractor tool, as well as a practice rod stake tool which may be used independently or together with the protractor tool, thereby providing a golf tool kit or system. One aspect is to provide a training tool which helps build muscle memory for desired swing mechanics and setup. Another aspect is to provide a versatile tool that can be used for a variety of different practice exercises. Another aspect is to provide a compact tool.

A golf protractor tool according to the present disclosure comprises a base bar, a protractor extending from a side of the base bar, and a swing arm pivotably mounted to the protractor. The protractor is a semicircular protractor with a 180° arc. A center or origin point of the 180° arc is offset from the side of the base bar from which the protractor extends. Preferably, the protractor has angular measurement markings for the 180° arc on both sides. The swing arm is positionally adjustable along the 180° arc of the protractor. For example, the swing arm may comprise two attachment limbs which extend on either side of the protractor and pivotably mount the swing arm to the protractor at the center point of the 180° arc of the protractor. Preferably, the swing arm comprises one or more window openings which extend through the swing arm over the portion of the protractor with angular measurement markings for the 180° arc, such that the user can read the precise angle measurement underneath the swing arm. In some embodiments, the swing arm has an adjustment knob arranged within a corresponding adjustment slot of the protractor for locking and unlocking the position of the swing arm on the protractor. In one example, the base bar has a rectangular profile with four sides.

Each of the swing arm and the base bar have one or more rod holder openings configured to hold practice rods. For example, an axial rod holder opening is provided in at least one end of the base bar and extends along a longitudinal axis of the base bar, such that a practice rod inserted into this axial rod holder opening is positioned along the longitudinal axis of the base bar. Preferably, the base bar has an axial rod holder opening at both ends. The swing arm also has an axial rod holder opening that is provided in an end of the swing arm opposite the protractor and extends along a longitudinal axis of the swing arm, such that a practice rod inserted into this axial rod holder opening is positioned along the longitudinal axis of the swing arm.

The swing arm may further have one or more transverse rod holder openings which extend through the swing arm perpendicular to the longitudinal axis of the swing arm. Preferably, on its side opposite the protractor, the base bar also has one or more transverse rod holder openings which extend through the base bar perpendicular to the longitudinal axis of the base bar, such that a practice rod inserted into the one or more transverse rod holder openings of the base bar is positioned perpendicular to the longitudinal axis of the base bar. In one example, the base bar comprises four transverse rod holder openings, with two located in the section of the base bar with the protractor, and two located outside the section of the base bar with the protractor on either side of the protractor.

On the side of the base bar with the protractor, the base bar may further comprise one or more angled rod holder openings which extend through the base bar at an angle to the longitudinal axis of the base bar, such that a practice rod inserted into the one or more angled rod holder openings is angled away from the protractor and oriented at the set angle. Preferably, the one or more angled rod holder openings are inclined at an angle of 55-65° relative to the longitudinal axis of the base bar. In some embodiments, the base bar has two angled rod holder openings, with a first angled rod holder opening located between the protractor and one end of the base bar, and a second angled rod holder opening located between the protractor and the other end of the base bar. Preferably, the two angled rod holder openings are provided at different angles from each other relative to the longitudinal axis of the base bar.

A further golf practice tool according to the present disclosure is provided by a practice rod stake tool. The stake tool comprises a grip and a stake shaft extending from the grip. The shaft may have circumferential ribs for anchoring the stake in the ground. The stake tool has a transverse rod holder, formed as a channel or opening in the grip, configured to hold a practice rod. The transverse rod holder extends through the grip perpendicular to the longitudinal axis of the shaft, such that a practice rod inserted into this holder is positioned perpendicular to the longitudinal axis of the shaft. The stake tool also has an axial rod holder, formed as a channel or opening, which extends from the grip into the interior of the stake along the longitudinal axis of the shaft, such that a practice rod inserted into this holder is positioned along the longitudinal axis of the shaft. The stake tool may be used independently or in conjunction with the golf protractor tool. For example, the stake tool may be incorporated into exercises using the protractor tool, thereby allowing the user to practice multiple aspects of the address and/or swing at the same time. In this case, the golf protractor tool and one or more practice rod stake tools together provide a golf practice tool system or kit.

In addition to aspects and embodiments described above, further aspects and embodiments will become apparent by reference to the appended drawings, wherein like reference numerals generally designate corresponding elements or structures in the several views.

BRIEF DESCRIPTION OF THE DRAWINGS

The following description is provided with reference to example embodiments using the accompanying figures, wherein.

Figure 1:
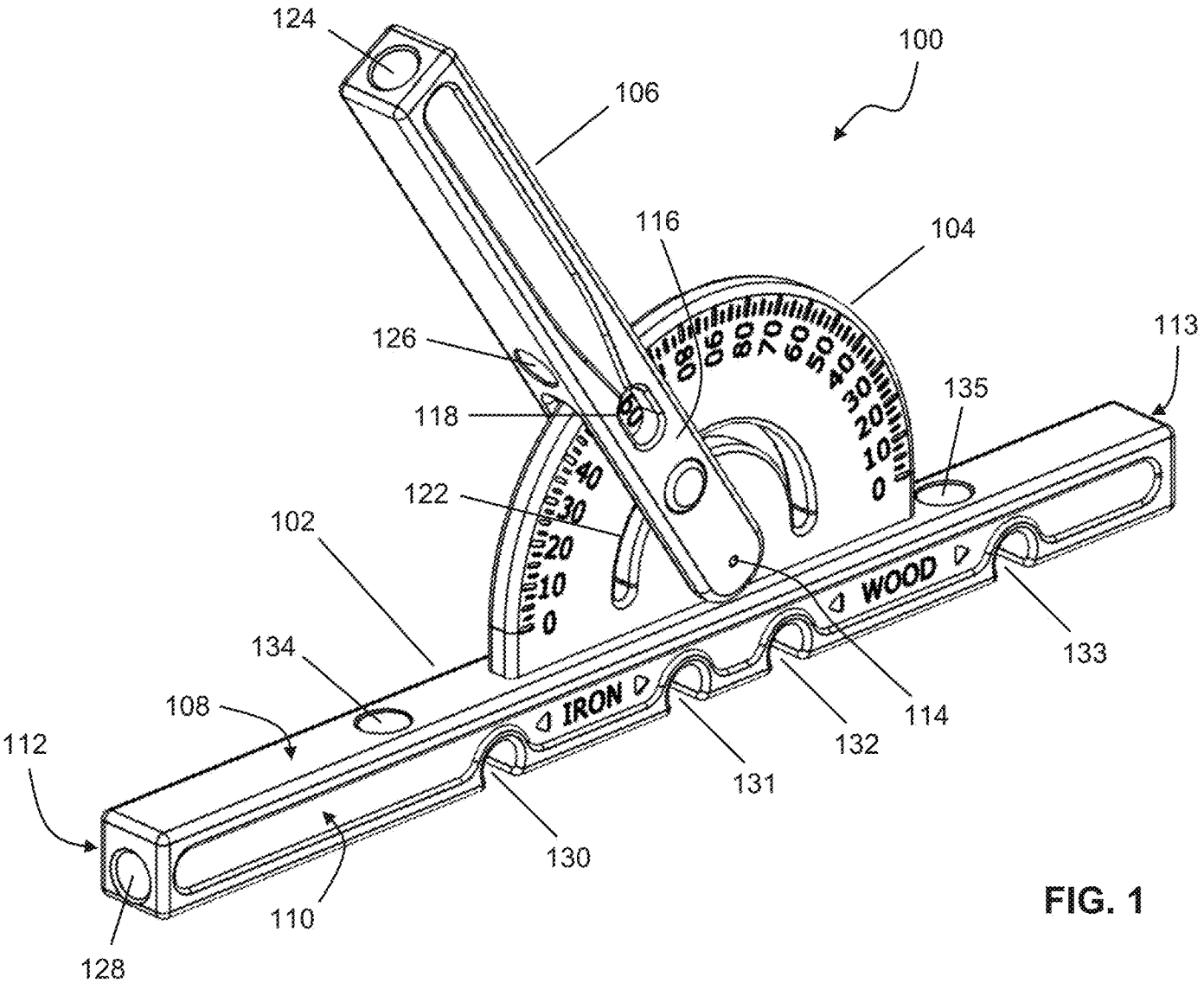
FIG. 1 shows a perspective view of an example golf protractor tool according to the present disclosure.
Figure 2:
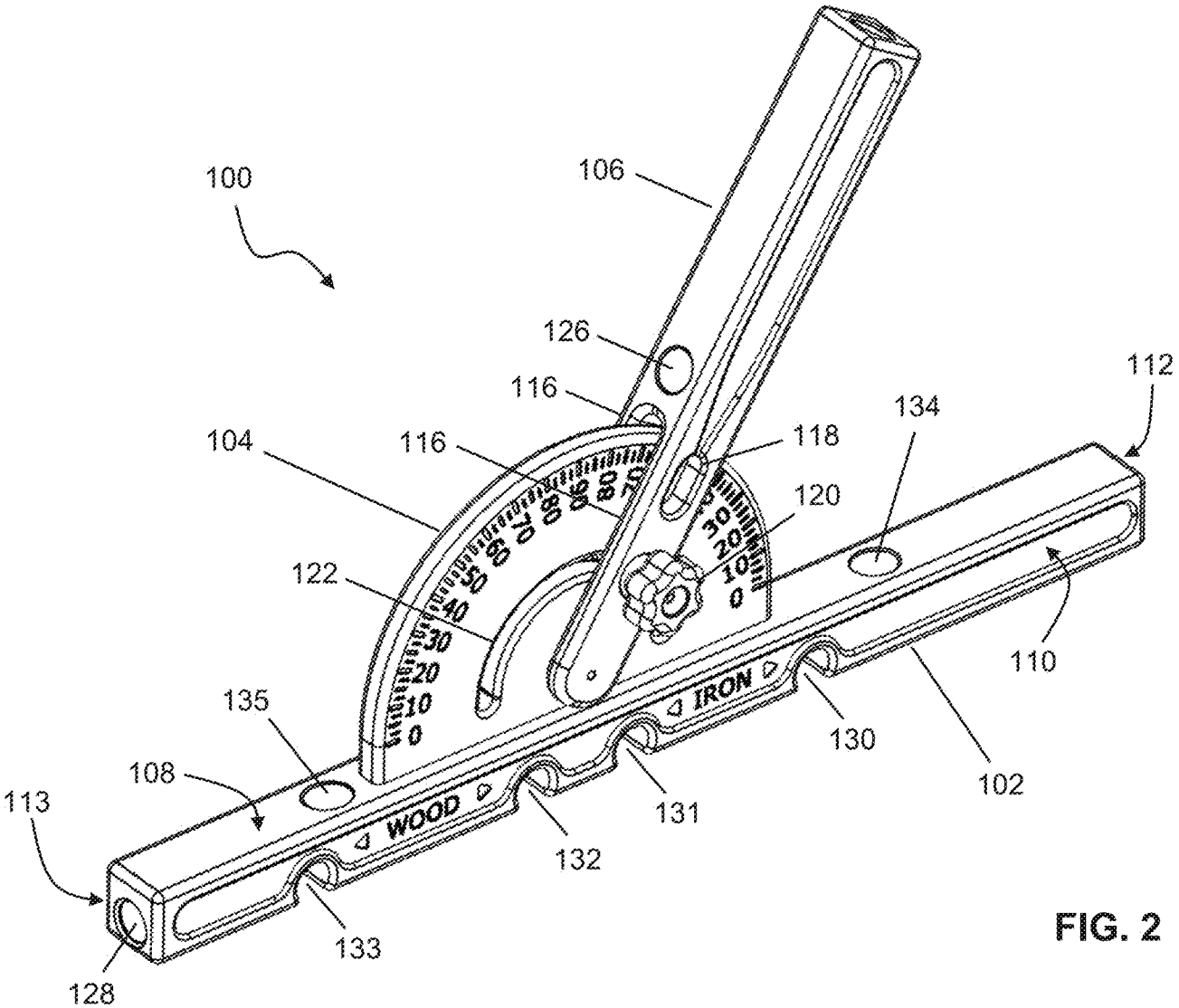
FIG. 2 shows another perspective view of the protractor tool from the other side.
Figure 3:
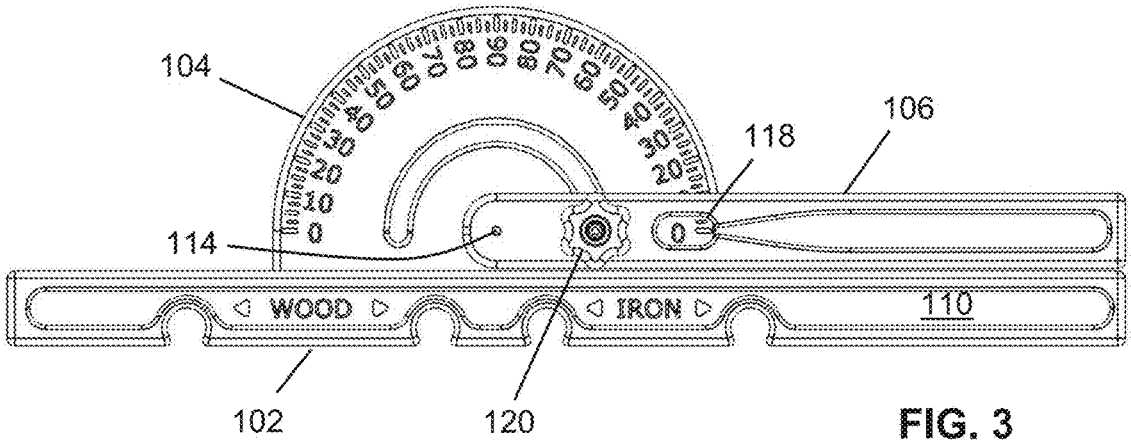
FIG. 3 shows a side view of the protractor tool with the swing arm in a storage position.
Figure 4:
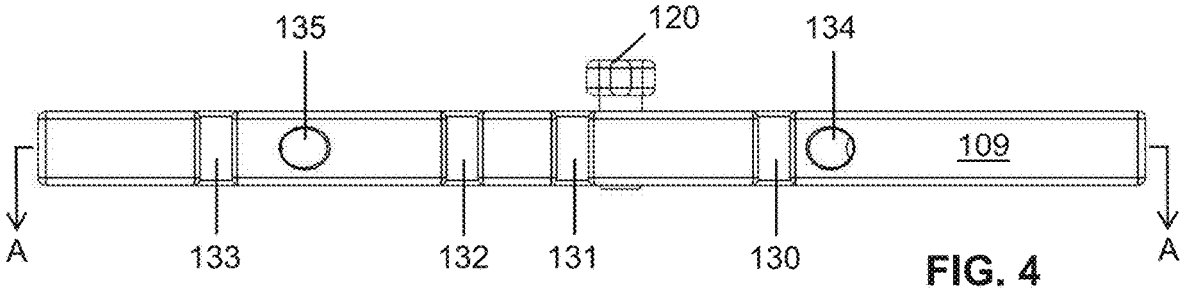
FIG. 4 shows a bottom view of the protractor tool.
Figure 5:
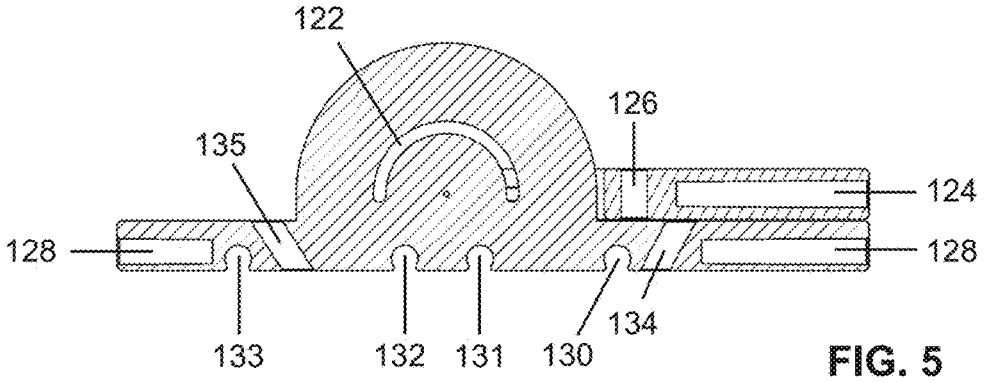
FIG. 5 shows a sectional view of the protractor tool taken along line A-A of FIG. 4.

Before explaining depicted embodiments, it is to be understood that the invention is not limited in application to the details of the particular arrangements shown, since the invention is capable of other embodiments. The embodiments and figures disclosed herein are to be considered illustrative rather than limiting. Also, the terminology used herein is for the purposes of description and not limitation.

DETAILED DESCRIPTION

Referring to FIGS. 1-5, a golf protractor tool 100 comprises a base bar 102, a protractor 104 extending from the base bar 102, and a swing arm 106 pivotably mounted with respect to the protractor 104. The protractor 104 is a semicircular protractor with a 180° scale on both sides and with the straight edge portion attached to the base bar 102. The scale is shown with 2.5° marking intervals, though other angle intervals may also be used. The origin or center point of the 180° arc of the protractor 104 is positioned at a distance from the base bar 102 to accommodate attachment and movement of the swing arm 106.

Preferably, the base bar 102 has a generally rectangular shape with four sides 108, 109, 110 and two ends 112, 113. The protractor 104 extends from a first side 108 of the base bar 102, which is opposite a second side 109 of the base bar 102. When the second side 109 is placed on the ground, as in some uses of the tool 100, the first side 108 faces upward and the protractor 104 is positioned vertically. When one of the sides 110 are placed on the ground, as in other uses of the tool 100, the first and second sides 108, 109 face laterally and the protractor 104 is positioned horizontally. The base bar 102 and the protractor 104 may be produced as one integral component, e.g. molded as a single piece, or produced as separate components which are then joined together during production assembly.

One end of the swing arm 106 is pivotably mounted to the protractor 104 at pivot point 114 (e.g. a pivot shaft) which corresponds to the origin point of the protractor 104, such that the position of the swing arm 106 is adjustable over the 180° arc of the protractor 104. On this end, the swing arm 106 is designed with two attachment limbs 116 which extend on either side of the protractor 104 and therefore accommodate the protractor 104 therebetween. Each limb 116 preferably comprises a window opening 118 which allows a user to see the angle markings of the protractor 104 underneath the swing arm 106, such that the user can determine and adjust the angular position of the swing arm 106 on the protractor 104. In the depicted example, the swing arm 106 has a knob 120 positioned within a slot 122 of the protractor 104 for fixing and unfixing, respectively, the position of the swing arm 106 on the protractor 104. Of course, other mechanisms may be used for adjustably setting and unsetting the position of the swing arm 106.

The other end of the swing arm 106, which faces away from the protractor 104, includes an axial rod holder 124 configured to receive the shaft of a practice rod. The rod holder 124 comprises an opening or channel which extends along the longitudinal axis of the swing arm 106, such that the practice rod is positioned along the longitudinal axis of the swing arm 106 when inserted in the rod holder 124. Preferably, the swing arm 106 also comprises at least one transverse rod holder 126 configured to receive the shaft of a practice rod. The transverse rod holder 126 is an opening or channel through the swing arm 106 perpendicular to the longitudinal axis of the swing arm 106. The direction of the rod holder 126 may be selected such that a practice rod inserted in the rod holder 126, when the swing arm 106 is positioned in the center of the protractor 104 at 90°, is either parallel (shown) or perpendicular (not shown) to the longitudinal axis of the base bar 102. The swing arm 106 may also have two transverse rod holders 126 such that both configurations are provided.

Preferably, the base bar 102 also comprises one or more rod holders formed as openings or channels configured to hold training rods. An axial rod holder 128 may be provided on one or both ends 112, 113 of the base bar 102, which positions the training rod along the longitudinal axis of the base bar 102. In the depicted embodiment, the base bar 102 further comprises transverse rod holders 130, 131, 132, 133 which each position the training rod perpendicular to the longitudinal axis of the base bar 102. In addition to use with exercises, one or more training rods inserted into any of the rod holders 128, 130, 131, 132, 133 also provide stability to the tool 100 when the second side 109 is placed on the ground and the protractor 104 is positioned vertically upward. In the depicted embodiment, the transverse rod holders 130, 131 are spaced apart from one another to provide a square clubface and hosel alignment for irons, while the transverse rod holders 132, 133 are spaced apart from one another to provide a square clubface and hosel alignment for drivers/woods.

Preferably, the base bar 102 has one or more angled rod holders 134, 135. For example, in the depicted embodiment, an angled rod holder 134 is formed in the top side 108 of the base bar 102 and inclined 62° relative to the longitudinal axis of the base bar 102, such that a training rod inserted into the rod holder 134 is also positioned 62° relative to the longitudinal axis of the base bar 102 pointing away from the protractor 104. Another angled rod holder 135 is formed in the top side 108 of the base bar 102, opposite rod holder 134 with respect to the protractor 104, and inclined 57° relative to the longitudinal axis of the base bar 102, such that a training rod inserted into the rod holder 135 is also positioned 57° relative to the longitudinal axis of the base bar 102 pointing away from the protractor 104. The 62° and 57° angles are preset in this case for convenience, as these angles are generally considered desirable for the lie angle (the angle formed between the club shaft and ground at the address) for irons and drivers/woods, respectively. In general, drivers and woods will typically have 55-60° lie angles, while irons and wedges will typically have 60-65° lie angles. Therefore, other embodiments may have different preset angles. Preferably, the angled rod holders 134, 135 are inclined 55-65° relative to the longitudinal axis of the base bar 102. Preferably, the angled rod holders 134, 135 are provided at different angles from each other to increase quick-use versatility.

Figure 6:
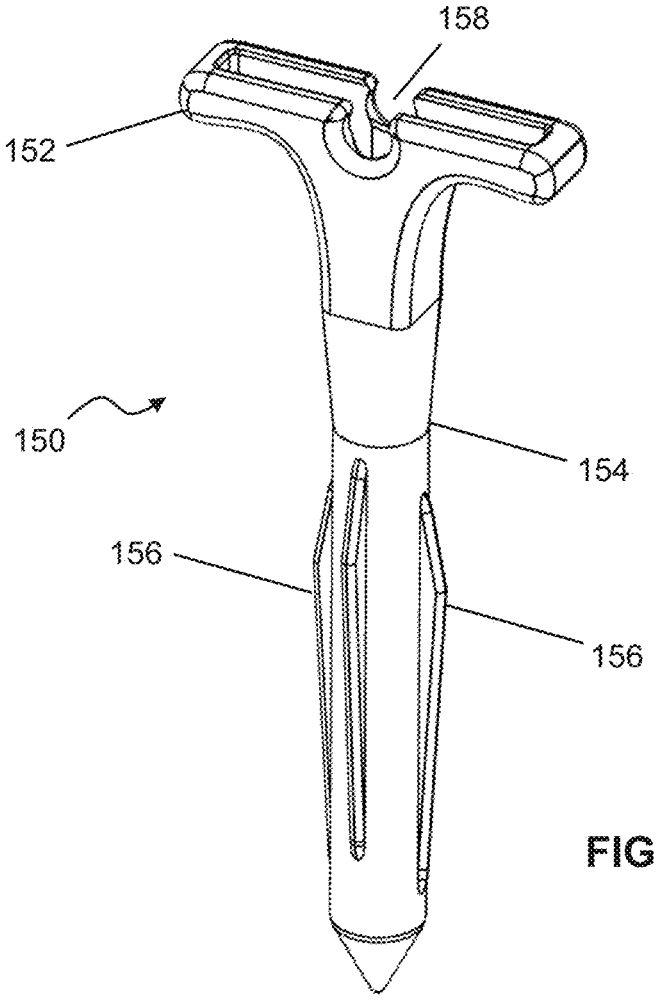
FIG. 6 shows a perspective view of an example practice rod stake tool according to the present disclosure.
Figure 7:
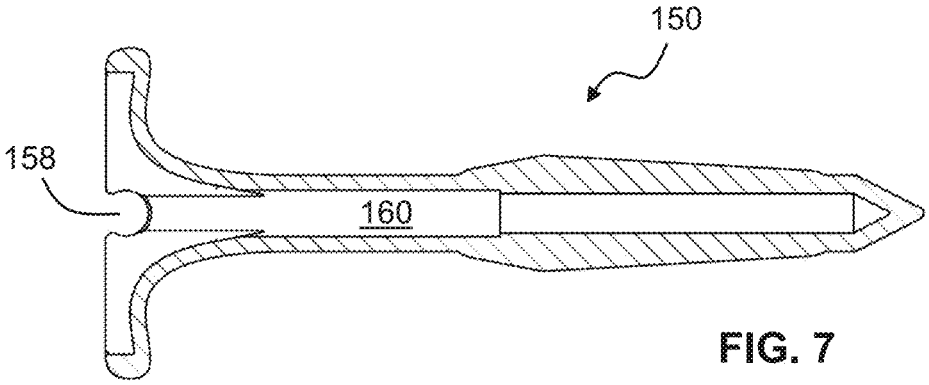
FIG. 7 shows a sectional view of the stake tool taken along its center plane.

Referring now to FIGS. 6 and 7, a practice rod stake tool 150 comprises a head or grip 152 and a stake body or shaft 154 extending from the grip 152. The shaft 154 may have circumferential ribs 156 for anchoring the stake tool 150 in the ground. The stake tool 150 has a transverse rod holder 158, formed as a channel or opening in the grip 152, configured to hold a practice rod. The transverse rod holder 158 extends through the grip 152 perpendicular to the longitudinal axis of the shaft 154, such that a practice rod inserted into the transverse rod holder 158 is positioned perpendicular to the longitudinal axis of the shaft 154. The stake tool 150 also has an axial rod holder 160 which extends from the grip 152 into the interior of the stake tool 150 along the longitudinal axis of the shaft 154, such that a practice rod inserted into the axial rod holder 160 is positioned along the longitudinal axis of the shaft 154. The stake tool 150 may be used independently or in conjunction with the golf protractor tool 100 as described below, and thus in the manner of a system comprising the golf protractor tool 100 and one or more practice rod stake tools 150, such as may be included for example with a training kit sold as a unit.

FIGS. 8-13 show various example uses of the golf protractor tool 100. The depicted uses are illustrative rather than exhaustive, since the functional versatility of the protractor tool 100 enables any number of possible uses. Only labeled in FIG. 8 though equally applicable to the other figures, a golf club 200 comprises a club head 202 with hosel 204 that connects to a shaft 206 (the remainder of the club shaft and grip are not shown). A golf ball is indicated with reference numeral 210. The figures show a right-handed golfer, though the same setups and exercises are equally available using the golf protractor tool 100 for left-handed golfers.

Figure 8:
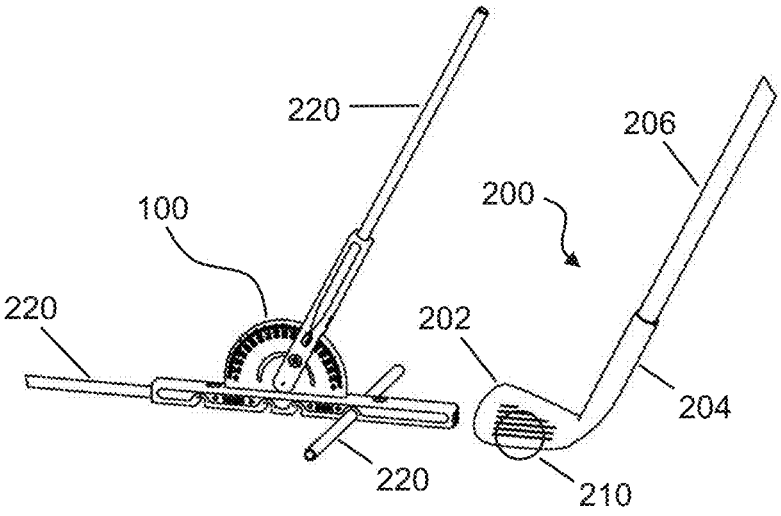
FIGS. 8-13 are schematic diagrams showing example uses of the protractor tool.

Referring to FIG. 8, the user is holding the golf club 200 at address to the golf ball 210. The protractor tool 100 is arranged in front of the user adjacent the golf ball 210, with the protractor 104 in a vertical position. In this example, three practice rods 220 are inserted into three rod holders of the protractor tool 100. One practice rod 220 is inserted into the axial rod holder 124 of the swing arm 106. The position of the swing arm 106 on the protractor 104 corresponds to the desired lie angle or swing plane for the golf club 200. Therefore, the user can reference this practice rod 220 during address in order to position the shaft 206 of the golf club 200 parallel to this practice rod 220 extending from the swing arm 106, and thus at the desired lie angle. Another practice rod 220 is inserted into the transverse rod holder 130 of the base bar 102, which corresponds to the target line of the path of the golf ball 210. Therefore, the user can reference this practice rod 220 during address in order to position the face of the club head 202 square with the target line. Another practice rod 220 is inserted into the axial rod holder 128 of the base bar 102 opposite the user and provides additional stability to the protractor tool 100.

Figure 9:
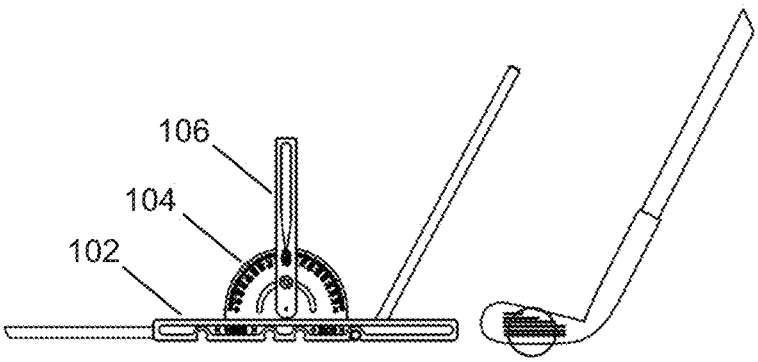

FIG. 9 is similar to FIG. 8, except that instead of the axial rod holder 124 of the swing arm 106, the angled rod holder 134 of the base bar 102 is holding the practice rod 220 at its preset angle for use in lie angle or swing plane alignment. In another application (not shown) with a similar setup as FIG. 8 or 9, the user holds a practice rod across his or her chest and turns in the manner of a backswing. The user can then compare the orientation of the held practice rod to the angled practice rod extending from protractor tool 100, which allows the user to practice a desired chest plane alignment. A similar exercise can also be used to practice a desired hip plane alignment for example.

Figure 10:
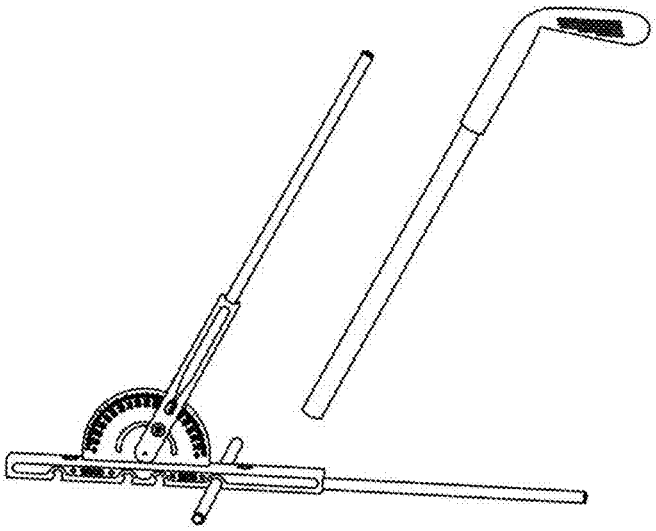

In FIG. 10, the protractor tool 100 is positioned to the right of the user on the backswing side. With this setup, the angled practice rod 220 inserted in the swing arm 106 may be used to practice a desired angle or swing plane of the golf club 200 during the backswing. The same applies for the follow-through swing if the protractor tool 100 is instead positioned to the left of the user at address.

Figure 11:
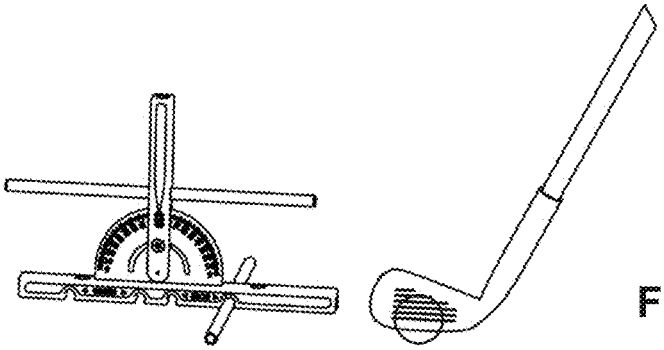

In FIG. 11, the swing arm 106 is positioned in the center of the protractor 104 at 90° such that the practice rod 220 in the transverse rod holder 126 is positioned parallel to the longitudinal axis of the base bar 102 and extends directly over the golf ball 210 during address. This setup can help the user practice squaring up the face of the club head 202 and making solid contact with the golf ball 210.

Figure 12:
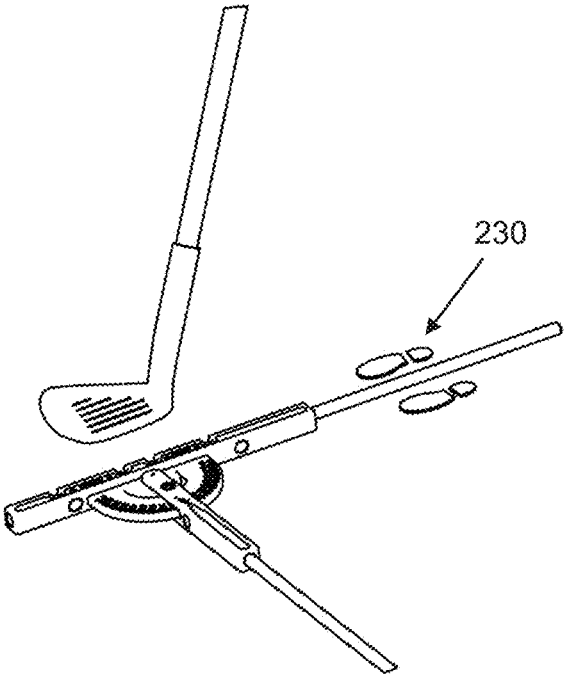

In FIG. 12, unlike in FIGS. 8-11, the protractor tool 100 is arranged with the swing arm 106 lying on the ground. The protractor tool 100 is arranged in front of the user here. The swing arm is positioned in the center of the protractor 104 at 90°. One practice rod 220 is inserted into the axial rod holder 124 of the swing arm 106, which provides the target line. The bottom side 109 of the base bar 102 is perpendicular to this practice rod 220 and therefore provides an alignment guide for the face of the club head 202. Another practice rod 220 is inserted into the axial rod holder 128 of the base bar 102 facing the user, and the user stands on either side of this practice rod 220 to position his or her body and feet. The user's stance is indicated by reference numeral 230. With this setup, the user can practice making a square address.

Figure 13:
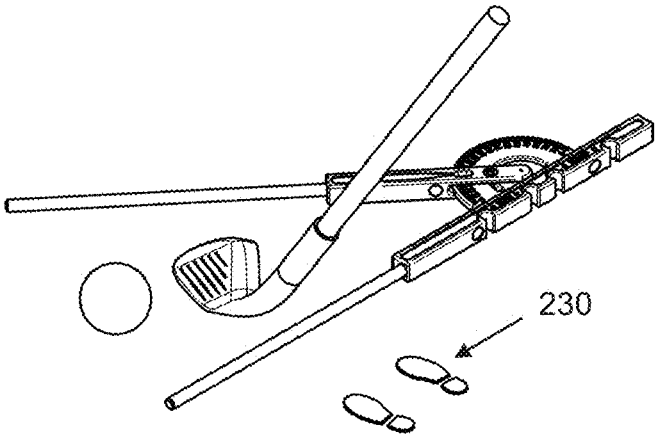

In FIG. 13, the protractor tool 100 is again arranged with the swing arm 106 lying on the ground. One practice rod 220 is inserted into the axial rod holder 124 of the swing arm 106, with the face of the club head 202 positioned adjacent and perpendicular to this practice rod 220. Another practice rod 220 is inserted into the axial rod holder of the base bar 102 facing the user, which provides an alignment guide for the user's stance 230. With this setup, the user can practice an open clubface address and swing, which is sometimes used in wedge and bunker play.

Figure 14:
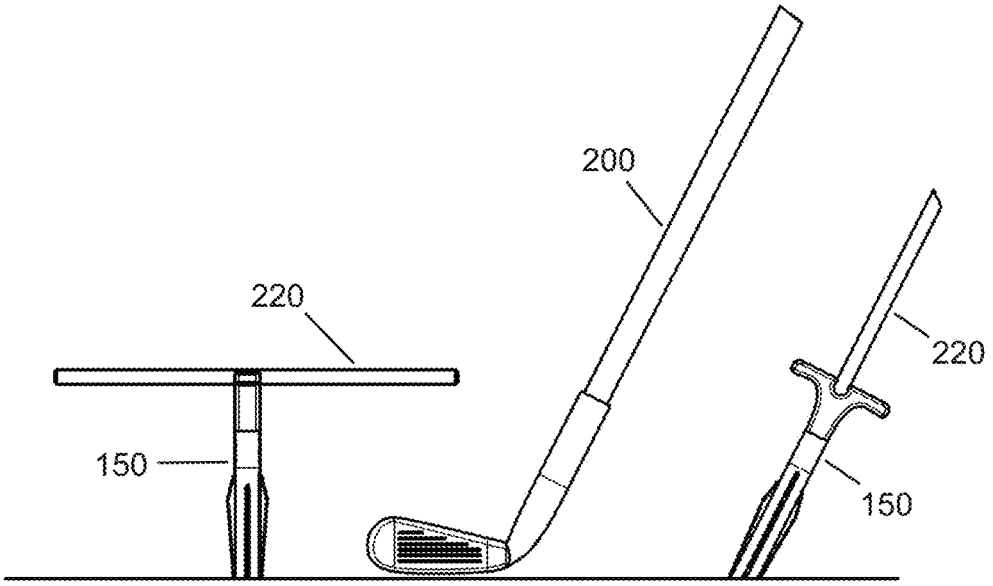
FIG. 14 is a schematic diagram showing example uses of the stake tool.

FIG. 14 shows example uses of the practice rod stake tool 150, which may be used independently or in conjunction with the protractor tool 100. The depicted uses are illustrative rather than exhaustive, since the functional versatility of the protractor tool 100 enables any number of possible uses. The stake tool 150 on the left is positioned vertically with a practice rod 220 inserted in its transverse rod holder 158. This setup may be used in the same manner as the use of FIG. 11 for example. The stake tool 150 on the right is positioned at an angle to the ground with a practice rod 220 inserted in its axial rod holder 160. This setup may be used in the same manner as the uses of FIGS. 8-10 for example. Moreover, for positioning the stake tool 150 at a desired angle, the protractor tool 100 may be arranged with the swing arm 106 positioned at the desired angle, and then the stake tool 150 driven into the ground next to the protractor tool 100 such that the practice rod 220 inserted in the axial rod holder 160 extends parallel to the adjacent swing arm 106 at the desired angle. Notably, the stake tool 150 allows a user to secure the position of a practice rod 220 where previously this may have been difficult with only the practice rod 220 due to terrain, such as for example in the case of sloped and/or uneven terrain as well as bunkers. The various setups of the stake tools 150 may be incorporated into other exercises using the protractor tool 100, thereby increasing their versatility and allowing the user to practice multiple aspects of the address and/or swing at the same time.

Preferably, all of the rod holder openings are designed to hold practice rods up to the same diameter (e.g. 8 mm), such that the same practice rods may be readily used with and interchanged between the different rod holders as desired for different training exercises.

While a number of aspects and embodiments have been discussed herein, those skilled in the art will recognize numerous modifications, permutations, additions, combinations and sub-combinations therefor, without same needing to be specifically explained in the context of this disclosure. The appended claims should therefore be interpreted to include all such modifications, permutations, additions and sub-combinations, which are within their true spirit and scope. Each embodiment described herein has numerous equivalents.

The terms and expressions which have been employed are used as terms of description and not of limitation, and there is no intention in the use of such terms and expressions of excluding any equivalents of the features shown or described, or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are hereby incorporated into this disclosure. When a Markush group or other grouping is used herein, all individual members of the group and all combinations and sub-combinations possible of the group are hereby individually included in this disclosure.

In general, the terms and phrases used herein have their art-recognized meaning, which can be found by reference to standard texts, references and contexts known to those skilled in the art. The above definitions are provided to clarify their specific use in the context of the invention.

LIST OF REFERENCES NUMERALS

100 golf protractor tool
102 base bar
104 protractor
106 swing arm
108, 109, 110 base bar sides
112, 113 base bar ends
114 swing arm pivot point
116 swing arm attachment limbs
118 swing arm window opening
120 swing arm adjustment knob
122 protractor adjustment slot
124 swing arm axial rod holder
126 swing arm transverse rod holder
128 base bar axial rod holders
130, 131, 132, 133 base bar transverse rod holders
134, 135 base bar angled rod holders
150 rod stake tool
152 rod stake grip
154 rod stake shaft
156 rod stake ribs
158 rod stake transverse rod holder
160 rod stake axial rod holder
200 golf club
202 golf club head
204 golf club hosel
206 golf club shaft
210 golf ball
220 practice rods
230 user stance

The invention claimed is:

1. A golf protractor tool comprising:

a base bar having one or more rod holder openings configured to hold practice rods, wherein an axial rod holder opening is provided in at least one end of the base bar and extends along a longitudinal axis of the base bar, such that a practice rod inserted into the axial rod holder opening of the base bar is positioned along the longitudinal axis of the base bar;

a protractor extending from a side of the base bar, wherein the protractor is a semicircular protractor with a 180° arc and a center point of the 180° arc offset from the side of the base bar;

a swing arm pivotably mounted to the protractor and positionally adjustable along the 180° arc of the protractor, wherein the swing arm has one or more rod holder openings configured to hold practice rods, and wherein an axial rod holder opening is provided in an end of the swing arm opposite the protractor and extends along a longitudinal axis of the swing arm, such that a practice rod inserted into the axial rod holder opening of the swing arm is positioned along the longitudinal axis of the swing arm.

2. The golf protractor tool of claim 1, wherein the swing arm has a transverse rod holder opening which extends through the swing arm perpendicular to the longitudinal axis of the swing arm.

3. The golf protractor tool of claim 1, wherein the swing arm comprises one or more window openings which extend through the swing arm over a portion of the protractor with angular measurement markings for the 180° arc of the protractor.

4. The golf protractor tool of claim 1, wherein the swing arm comprises two attachment limbs which extend on either side of the protractor and pivotably mount the swing arm to the protractor at the center point of the 180° arc of the protractor.

5. The golf protractor tool of claim 1, wherein the swing arm has an adjustment knob arranged within an adjustment slot of the protractor for locking and unlocking a position of the swing arm on the protractor.

6. The golf protractor tool of claim 1, wherein the protractor has angular measurement markings for the 180° arc on both sides.

7. The golf protractor tool of claim 1, wherein the base bar has a rectangular profile with four sides.

8. The golf protractor tool of claim 1, wherein the axial rod holder opening of the base bar is a first axial rod holder opening provided in a first end of the base bar, and the base bar has a second axial rod holder opening provided in a second end of the base bar which extends along the longitudinal axis of the base bar, such that a practice rod inserted into the second axial rod holder opening of the base bar is positioned along the longitudinal axis of the base bar.

9. The golf protractor tool of claim 1, wherein, opposite the side of the base bar with the protractor, the base bar comprises one or more transverse rod holder openings which extend through the base bar perpendicular to the longitudinal axis of the base bar, such that a practice rod inserted into the one or more transverse rod holder openings of the base bar is positioned perpendicular to the longitudinal axis of the base bar.

10. The golf protractor tool of claim 9, wherein the base bar comprises four transverse rod holder openings, with two of the transverse rod holder openings of the base bar provided in a section of the base bar with the protractor, one of the transverse rod holder openings of the base bar provided outside the section of the base bar on one side of the protractor, and one of the transverse rod holder openings of the base bar provided outside the section of the base bar on another side of the protractor.

11. The golf protractor tool of claim 1, wherein, on the side of the base bar with the protractor, the base bar comprises one or more angled rod holder openings which extend through the base bar toward an opposite side of the base bar at an angle to the longitudinal axis of the base bar, such that a practice rod inserted into the one or more angled rod holder openings is angled away from the protractor.

12. The golf protractor tool of claim 11, wherein the one or more angled rod holder openings are inclined at an angle of 55-65° relative to the longitudinal axis of the base bar.

13. The golf protractor tool of claim 11, wherein the base bar has two angled rod holder openings, with a first angled rod holder opening located between the protractor and a first end of the base bar, and a second angled rod holder opening located between the protractor and a second end of the base bar, and wherein the first and second angled rod holder openings are provided at different angles from each other relative to the longitudinal axis of the base bar.

14. A golf protractor tool comprising:

a base bar having axial rod holder openings and transverse rod holder openings, which are configured to hold practice rods;

a protractor extending from a side of the base bar, wherein the protractor is a semicircular protractor with a 180° arc and a center point of the 180° arc offset from the side of the base bar, and wherein the protractor has angular measurement markings for the 180° arc on both sides;

a swing arm pivotably mounted to the protractor and positionally adjustable along the 180° arc of the protractor, and wherein the swing arm has an axial rod holder opening and a transverse rod holder opening, which are configured to hold practice rods;

wherein a first axial rod holder opening of the base bar is provided in a first end of the base bar, a second axial rod holder opening of the base bar is provided in a second end of the base bar, and the first and second axial rod holder openings of the base bar extend along the longitudinal axis of the base bar, such that a practice rod inserted into either one of the first and second axial rod holder openings of the base bar is positioned along the longitudinal axis of the base bar;

wherein the transverse rod holder openings of the base bar are provided opposite the side of the base bar with the protractor, and the transverse rod holder openings extend through the base bar perpendicular to the longitudinal axis of the base bar, such that a practice rod inserted into any one of the transverse rod holder openings of the base bar is positioned perpendicular to the longitudinal axis of the base bar;

wherein the axial rod holder opening of the swing arm is provided in an end of the swing arm opposite the protractor and extends along a longitudinal axis of the swing arm, such that a practice rod inserted into the axial rod holder opening of the swing arm is positioned along the longitudinal axis of the swing arm;

wherein the transverse rod holder opening of the swing arm extends through the swing arm perpendicular to the longitudinal axis of the swing arm.

15. The golf protractor tool of claim 14, wherein the swing arm comprises two attachment limbs which extend on either side of the protractor and pivotably mount the swing arm to the protractor at the center point of the 180° arc of the protractor, and each of the two attachment limb comprises a window opening which extends through the swing arm over a portion of the protractor with angular measurement markings for the 180° arc of the protractor.

16. The golf protractor tool of claim 14, wherein the swing arm has an adjustment knob positioned within an adjustment slot of the protractor for locking and unlocking a position of the swing arm on the protractor.

17. The golf protractor tool of claim 14, wherein the base bar further comprises angled rod holder openings, with a first angled rod holder opening provided on the side of the base bar with the protractor between the protractor and the first end of the base bar, and a second angled rod holder opening provided on the side of the base bar with the protractor between the protractor and the second end of the base bar, and wherein each angled rod holder opening extends through the base bar toward an opposite side of the base bar at an angle to the longitudinal axis of the base bar, such that a practice rod inserted into either one of the first and second angled rod holder openings is angled away from the protractor.

18. The golf protractor tool of claim 17, wherein the angled rod holder openings are inclined at an angle of 55-65° relative to the longitudinal axis of the base bar, and wherein the first and second angled rod holder openings are provided at different angles from each other relative to the longitudinal axis of the base bar.

19. The golf protractor tool of claim 14, wherein the base bar has a rectangular profile with four sides.

20. The golf protractor tool of claim 14, wherein the base bar has four transverse rod holder openings, with two of the transverse rod holder openings of the base bar provided in a section of the base bar with the protractor, and with two of the transverse rod holder openings of the base bar provided outside the section of the base bar with the protractor on either side of the protractor.

* * * * *